US005660395A

United States Patent [19]

Marshall

[11] Patent Number: 5,660,395

[45] Date of Patent: Aug. 26, 1997

[54] HAND-HELD VOLLEYBALL SPIKING TRAINER DEVICE

[76] Inventor: Jerry Marshall, P.O. Box 683, Rogers, Tex. 76569

[21] Appl. No.: 643,190

[22] Filed: May 6, 1996

[51] Int. Cl.[6] ..... A63B 69/00

[52] U.S. Cl. ..... 473/418

[58] Field of Search ..... 273/411, 414

[56] References Cited

U.S. PATENT DOCUMENTS 3,897,950 8/1975 Keller ..... 273/411

FOREIGN PATENT DOCUMENTS 2807743 9/1979 Germany ..... 273/411

*Primary Examiner*—William H. Grieb

*Attorney, Agent, or Firm*—H. Dale Langley, Jr.

[57] ABSTRACT

A volleyball spiking practice device positions a volleyball at a desired elevation above a surface. The device comprises a generally C-shaped head and a support pole attached to the head. The head sufficiently retains a volleyball to be knocked free. The support pole is attached with the head at an angle so that the support pole extends laterally away from the head when vertically disposed, to position the volleyball. The support pole is hand-held.

8 Claims, 2 Drawing Sheets

HAND-HELD VOLLEYBALL SPIKING TRAINER DEVICE

BACKGROUND OF THE INVENTION

The present invention relates to a device for use in volleyball training and, more particularly, to such a device for maintaining a volleyball at a desired height for spike shot training of volleyball athletes.

In the game of volleyball, a particular ball-hitting move is referred to as a "spike". In a spike, the volleyball athlete jumps to meet a descending ball at a point above the top of the volleyball net. At that point, the volleyball athlete hits the ball, directing it downward over the top of the net. Spiking requires a high level of skill and coordination of volleyball athletes. It is, therefore, desirable to provide means for practicing the spike shot in volleyball.

In order to practice spiking a volleyball, the volleyball must be located some distance above the top of the volleyball net on the side of the net on which the volleyball athlete hits the volleyball. The volleyball athlete jumps up and downwardly directs hand movement to contact the volleyball. In a successful spike shot, the hand contact with the volleyball directs the volleyball over the net, but downwardly within the boundary lines of the volleyball court. The spike is a particularly effective shot in volleyball. The skilled volleyball athlete is able to direct the spiked ball in a desired direction and at a fast rate of speed. Because of this, defending a spike is not easy. Skilled spiking is, therefore, a favored attribute of volleyball athletes.

Several devices for practicing volleyball spiking are known. These devices are each attached with a fixed base, or otherwise fixed to a wall or the volleyball net. The devices are, thus, not easily moveable or transported. Certain of the devices allow for varying the height at which a volleyball is maintained relative to the court floor, however, moving mechanical equipment must typically be operated to vary that height. As can be easily understood, the mechanical equipment must be maintained and is subject to wear and breakage. Furthermore, certain of the conventional spiking practice devices have included vertically positioned poles for maintaining a volleyball at the desired height. Such vertically positioned poles located in the direct vicinity of the volleyball athlete's jump in spiking practice can be a safety hazard to the athlete that jumps into the pole.

It would be a significant improvement in the art and technology to provide a simplified device for maintaining a volleyball at a desired height to allow volleyball athletes to practice spiking. It would also be an improvement to provide such a device that is economical in comparison to the prior devices and that allows for ease of manipulation and operation at varied heights and locations. Additional advantages of improved safety, and others, would also be improvements in the art. The present invention provides these and other advantages.

SUMMARY OF THE INVENTION

An embodiment of the invention is a volleyball spiking practice device. The device positions a volleyball at a desired elevation above a surface. The device comprises a generally C-shaped head for sufficiently retaining a volleyball to be knocked free and a support pole attached to the head. The support pole is attached with the head at an angle so that the support pole extends laterally away from the head when vertically disposed, to position the volleyball.

In another aspect, the support pole is freely transported over the surface.

In yet another aspect, the generally C-shaped head is pentagonally shaped with a horizontally disposed opening for sufficiently retaining the volleyball.

In a further aspect, the generally C-shaped head has a horizontally disposed opening, slightly smaller than a diameter of the volleyball.

In yet a further aspect, a side of the head adjacent the opening forms an angle of between about 10° to about 60° with the support pole.

In another aspect, the support pole forms an angle of between about 5° to about 75° with vertical in relation to the surface when the volleyball is positioned at the desired elevation above the surface.

Another embodiment of the invention is a method for volleyball spiking practice. The method comprises the steps of retaining a volleyball within an opening of a generally C-shaped head attached with a support pole and moving the support pole to raise the generally C-shaped head to a desired elevation. The support pole extends laterally away from the C-shaped head in the moving step.

Yet another embodiment of the invention is a device for positioning a volleyball at a desired elevation above a surface. The device consists essentially of a head for sufficiently retaining a volleyball to be hocked free and a hand-held support pole attached to the head.

DESCRIPTION OF THE PREFERRED EMBODIMENTS

Figure 1:
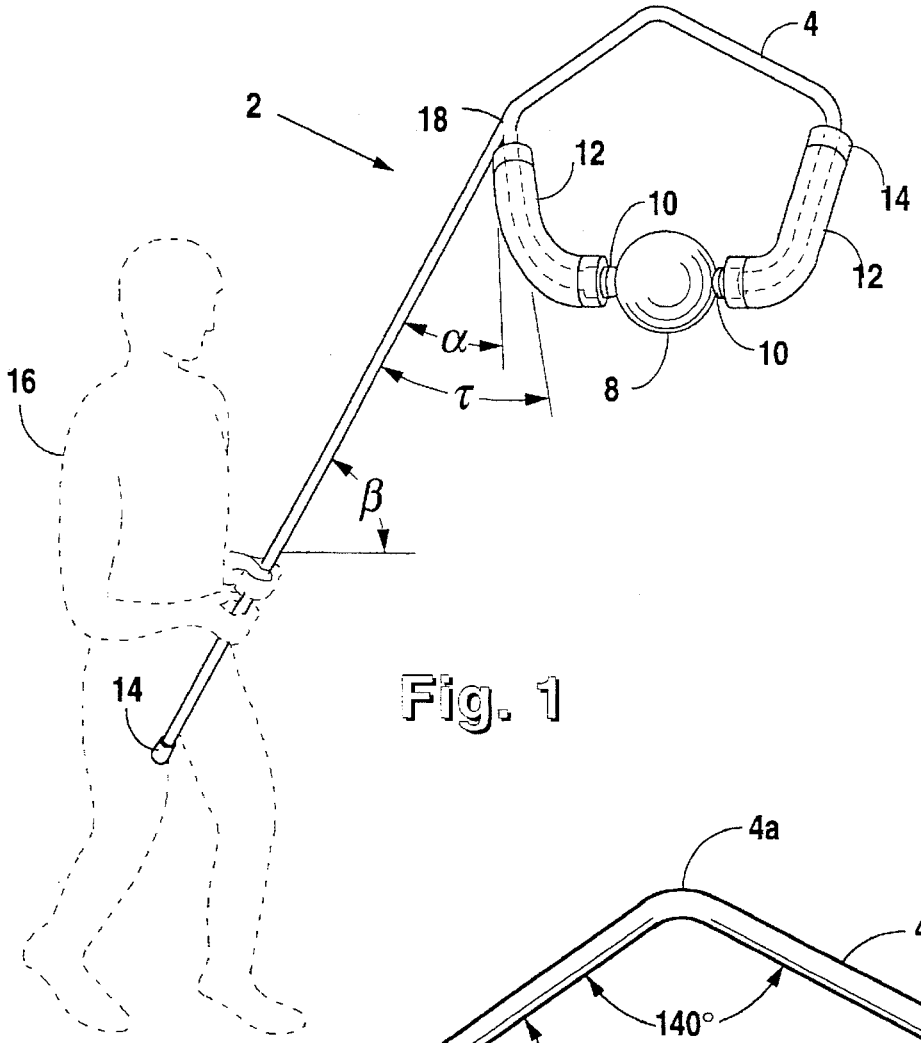
FIG. 1 is a front view of the volleyball spiking practice device according to embodiments of the present invention, showing in phantom an assistant holding the device for such practice.

Referring to FIG. 1, the reference numeral 2 refers, in general, to the volleyball spiking practice device 2 according to certain embodiments of the present invention. The device 2 comprises a volleyball retention head 4 attached with a support pole 6. The retention head 4 may be generally pentagonally shaped. The head 4 may include an opening, slightly smaller than a diameter of a volleyball 8, along the base of the head 4. The opening is of such a size as to allow a volleyball 8 to be maintained between ends of the volleyball retention head 4 at the opening. The head 4 may, alternatively, be of other generally C-shaped configurations, with the opening being of such size for such purpose.

The volleyball retention head 4 is attached with the support pole 6 so that the opening of the head 4 (and, thus, a volleyball maintained therein) may be located at a desired vertical height above a floor surface. The support pole 6 may be substantially straight. Alternatively, the support pole 6 could be configured as an arc, or some other configuration, in keeping with the purposes for the pole 6 described herein.

Figure 2:
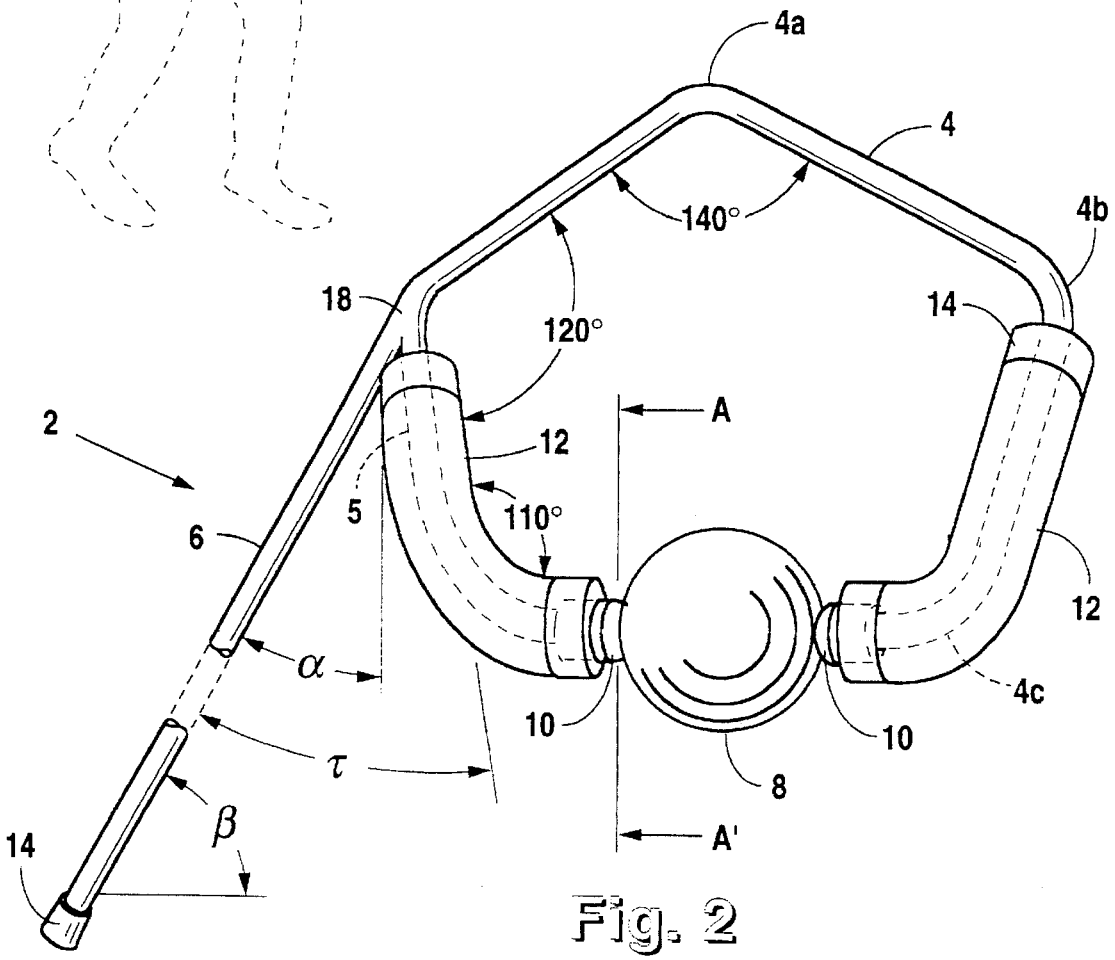
FIG. 2 is a vertically foreshortened, front view of the volleyball spiking practice device of FIG. 1, showing the device in greater detail.

Referring now to FIG. 2, in conjunction with FIG. 1, further details of the volleyball spiking practice device 2 may be understood. At the ends of the volleyball retention head 4 adjacent to the opening, the ends may be capped with ball contact end caps 10. These end caps 10 may serve to better retain the volleyball 8 within the opening of the volleyball retention head 4 and to prevent damage to the volleyball when so retained. A pole end cap 14 may cover the bottom end of the support pole 6.

On either side of the opening of the volleyball retention head 4, the head 4 may be covered with cushions 12, such as, for example, cylindrical tube foam. The cushions 12 may be fixed with the volleyball retention head 4 by tapes 14 at the ends of the cushions 12. Other means may alternatively serve to maintain the cushions 12 in place.

Figure 3:
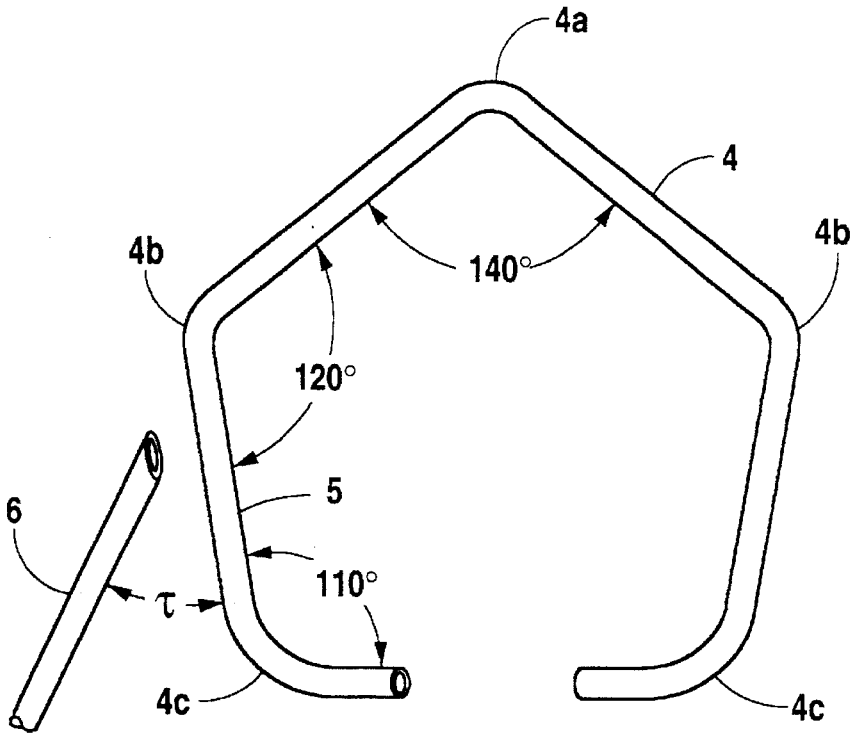
FIG. 3 is an exploded view of a generally C-shaped volleyball retention head and a support pole of the volleyball spiking practice device, according to embodiments of the present invention.

Referring to FIG. 3, in conjunction with FIG. 2, the support pole 6 and volleyball retention head 4 configuration may be addressed. The support pole 6 and retention head 4 may each be separate members that are joined in a conventional manner. One possibility is that the retention head 4 may be welded to the support pole 6 at the connection 18 (shown in FIG. 2). Alternatively, the retention head 4 and support pole 6 could be made of a single member, or more than two members.

In any event, the retention head 4 may be generally pentagonally shaped and the support pole 6 may extend from the head 4 at an angle **4*b* of the volleyball retention head 4. That angle 4*b* is the next bend adjacent a head apex angle 4*a*. At the angle 4*b*, the support pole 6 may extend from the head 4 in such a manner that the support pole 6 is directed downward and away from the head 4 and that the head 4 is located with its opening positioned at the base of the head 4. This arrangement will allow a volleyball 8 (shown in FIG. 2) to be maintained within the opening of the head 4 at a desired elevation with relation to the floor surface (see FIG. 1**).

Referring to FIGS. 1 and 2, in conjunction, the support pole 6, for example, may be extended at an angle $\beta$ with respect to the horizontal, and the opening of the head 4, in such instance, maintains parallelism in relation to the floor surface. An angle $\propto$ of the support pole 6 with respect to vertical at the retention head 4 is dictated by the desired distance that the support pole 6 extends from the location of the volleyball retention head 4. These particular angles from horizontal and vertical of the support pole 6 provide favorable characteristics of the device 2, such as, for example, added clearance because the pole 6 extends away from the head 4 when positioned for use in spiking practice. If the pole 6, instead, extended vertically downward from the head 4, volleyball athletes could hit the pole 6 when jumping to spike the volleyball 8 lodged in the opening of head 4.

Referring back to FIG. 1, a human assistant 16 (shown in phantom) may hold the support pole 6 to position the volleyball 8 maintained in the opening of the retention head 4 at a desired vertical distance above the floor surface. When held at that distance from the floor surface, a volleyball athlete may jump up and knock the volleyball 8 from the opening of the volleyball retention head 4 in a spike movement. Thereafter, the volleyball 8 may again be placed within the opening of the retention head 4 to allow the volleyball athlete to again strike the volleyball 8 in a spike manner at the desired elevation. Employing this approach, the volleyball spiking practice device 2 may be employed to coach and practice volleyball spiking movements.

Referring now to FIGS. 2–3, in conjunction, in constructing the device 2 according to certain embodiments, an approximately four foot section of metal tubing, such as an electrical conduit, may be cut. The four foot section may be bent to form an apex angle **4*a* on the order of about 140°. At points on each side of, and about eight to ten inches from, the angle 4*a*, additional bends in the same direction as the angle 4*a* may be formed. These additional bends form angles 4*b***, which each may be on the order of about 120°.

Two more bends may then be made, each approximately eight to ten inches from the angles **4*b*, respectively, towards the ends of the four foot section. These bends may be made to form angles 4*c* on the order of about 110° to form an open base of the generally pentagonally shaped volleyball retention head 4. The opening of the volleyball retention head 4 may be slightly smaller than the diameter of the volleyball 8. Because the opening is slightly smaller than the volleyball 8 diameter, the head 4 clamps the volleyball 8 and retains it. The volleyball retention head 4 must, therefore, be formed of a rigid, but flexible, material, so that it may be easily bent to hold a volleyball 8 within the opening and, yet, maintain sufficient rigidity to retain the volleyball 8** therein.

At one of the angles **4*b*, the support pole 6 is welded to the volleyball retention head 4. The support pole 6 is positioned in its weld with the volleyball retention head 4 in such a manner that the pole 6 is angled from the head 4, as previously described. In one possible arrangement, the support pole 6 may, for example, be angled at an angle $\tau$ of about 25° from a side 5 of the volleyball retention head 4. This angle $\tau$ of the support pole 6 with respect to the volleyball retention head 4 allows a human assistant 16 (See FIG. 1) to hold the support pole 6 with the volleyball retention head 4 at a desired vertical elevation, and yet to stand several feet from the vertical directly beneath the volleyball retention head 4. This arrangement of the support pole 6 is desirable because volleyball athletes will be less likely to jump into the support pole 6 or the human assistant 16** when practicing volleyball spiking.

Although a variety of materials may be employed to construct the volleyball spiking practice device 2, a particularly suitable material is a metal tube, such as an electrical conduit. Electrical conduit, for example, may be purchased in ten foot lengths. With such a ten foot length, a single volleyball spiking practice device 2 may be constructed. Alternatively, the device may be formed of other metal, composite, plastic, or other materials. Also, alternatively, the device 2 may be formed of non-cylindrical lengths and/or from solid, rather than hollow, materials. A wide variety of materials types, styles, and configurations are possible in accordance with the embodiments.

Figure 4:
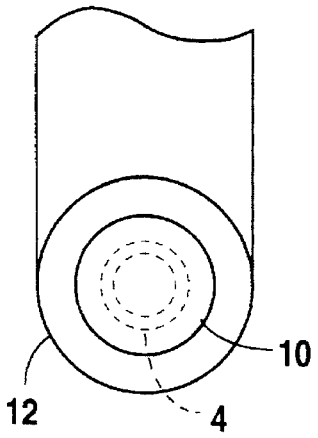
FIG. 4 is a partial, side view, along lines A–A' of FIG. 2, of an end cap and retention head portion of the device, which end cap contacts and, together with a substantially identical opposing portion, maintains a volleyball within the opening of the retention head.
Figure 5:
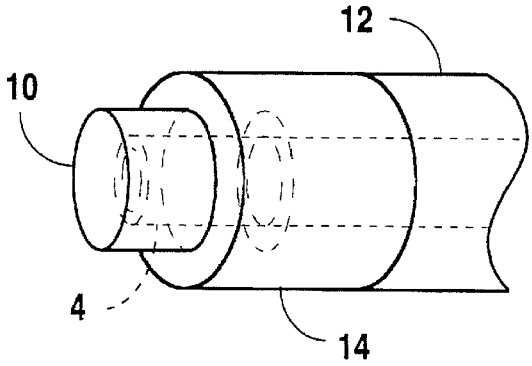
FIG. 5 is a partial perspective view of an end cap and retention head portion of the device, showing the retention head tubing and internal portions of the end caps in phantom.

Referring now to FIGS. 4–5, in conjunction, and in conjunction with FIGS. 1–2, each exposed end of the volleyball retention head 4 is covered with a ball contact end cap 10 and the exposed end of the support pole 6 is covered by a pole end cap 14. Various styles, types and configurations of end caps 10, 14 may be employed, as those skilled in the art will know. Furthermore, the end caps 10, 14 may, in certain embodiments, be covered (not shown in the Figures) by other or alternative materials, such as, for example, portions of safety cushions 12 or other materials, that help retain the volleyball 8.

The two sides 5 and the bottom portions of the head 4 near the opening may, as well, be covered with the safety cushions 12. One possible type of safety cushion 12 is insulation for metal tubing of the diameter of a metal tube employed to construct the volleyball retention head 4. If employing such type of insulation as the cushion 12, the insulation may be placed around the volleyball retention head 4 tubing and retained in place, for example, by strong tapes 14 placed at the ends of the cushions 12. Of course, other cushioning means may be employed, the intention being to avoid injury if the volleyball athlete in spiking practice misses the volleyball 8 and contacts the volleyball retention head 4.

It is to be understood that multiple variations, changes and modifications are possible in the aforementioned embodiments of the invention. Although illustrative embodiments of the invention have been shown and described, a wide range of modification, change, and substitution is contemplated in the foregoing disclosure and, in some instances, some features of the present invention may be employed without a corresponding use of the other features. Accordingly, it is appropriate that the foregoing description be construed broadly and understood as being given by way of illustration and example only, the spirit and scope of the invention being limited only by the appended claims.

What is claimed is:

1. A volleyball spiking practice device, the device positions a volleyball at a desired elevation above a surface, comprising:

a generally C-shaped head for sufficiently retaining a volleyball to be knocked free, the head including an opening deigned by opposed ends thereof, the opening being slightly smaller than the diameter of the volleyball, the head being sufficiently flexible so that in response to the head being bent to receive the volleyball, the volleyball is clamped in position within the opening by the opposed ends; and a support pole attached to the head, the support pole being attached with the head at an angle so that the support pole extends laterally away from the head when vertically disposed, to position the volleyball.

2. The device of claim 1, wherein the support pole is freely transported over the surface.

3. The device of claim 1, wherein the generally C-shaped head is pentagonally shaped with the opening being horizontally disposed for sufficiently retaining the volleyball.

4. The device of claim 3, wherein a side of the head adjacent the opening fores an angle of between about 10° to about 60° with the support pole.

5. The device of claim 1 wherein the support pole forms an angle of between about 5° to about 75° with vertical in relation to the surface when the volleyball is positioned at the desired elevation above the surface.

6. A method for volleyball spiking practice, comprising the steps of:

retaining a volleyball within an opening of a generally C-shaped, flexible head, the opening being slightly smaller than the diameter of the volleyball and being defined by opposed ends;

flexing the ends to received the volleyball therebetween; placing the volleyball between the ends whereby the flexed ends clamp the volleyball within the opening;

attaching a support pole to be angularly disposed relative to the head; and moving the support pole to raise the generally C-shaped head to a desired elevation, whereby the support pole extends laterally away from the C-shaped head.

7. A device for positioning a volleyball at a desired elevation above a surface, comprising:

a rigid, flexible head for sufficiently retaining a volleyball to be knocked free, the head including an opening defined by opposed end portions thereof, the opening being slightly smaller than the diameter of the volleyball, the head being sufficiently flexible, whereby, when the head is flexed apart at the opening to receive the volleyball, the volleyball is clamped in position within the opening by the opposed ends; and a hand-held support pole attached to the head.

8. A volleyball spiking practice device, the device positions a volleyball at a desired elevation above a surface comprising:

a generally C-shaped head for sufficiently retaining a volleyball to be knocked free;

a support pole attached to the head, the support pole being attached with the head at an angle so that the support pole extends laterally away from the head when vertically disposed to position the volleyball;

the C-shaped head being pentagonally shaped with a horizontally disposed opening for sufficiently retaining the volleyball; and a side of the head adjacent the opening forms an angle of between about 10° to about 60° with the support pole.

* * * * *

UNITED STATES PATENT AND TRADEMARK OFFICE

CERTIFICATE OF CORRECTION

PATENT NO. : 5,660,395

DATED : August 26, 1997

INVENTOR(S) : Jerry Marshall

It is certified that error appears in the above-identified patent and that said Letters Patent is hereby corrected as shown below:

In column 2,line 25, delete "hocked" and substitute "knocked"

In column 5, item 1., line 41, delete "deigned" and insert "defined".

Signed and Sealed this

Fifteenth Day of September, 1998

*Attest:*

*Attesting Officer*

Bruce Lehman

BRUCE LEHMAN

*Commissioner of Patents and Trademarks*